US008696830B2

(12) United States Patent
Moyer

(10) Patent No.: US 8,696,830 B2
(45) Date of Patent: Apr. 15, 2014

(54) STAINLESS STEEL CARBURIZATION PROCESS

(76) Inventor: Kenneth H. Moyer, Cinnaminson, NJ (US)

( * ) Notice: Subject to any disclaimer, the term of this patent is extended or adjusted under 35 U.S.C. 154(b) by 0 days.

(21) Appl. No.: 13/336,723

(22) Filed: Dec. 23, 2011

(65) Prior Publication Data

US 2012/0111454 A1 May 10, 2012

Related U.S. Application Data

(63) Continuation-in-part of application No. 12/971,068, filed on Dec. 17, 2010, now Pat. No. 8,425,691.

(60) Provisional application No. 61/366,477, filed on Jul. 21, 2010.

(51) Int. Cl.
*C23C 8/22* (2006.01)

(52) U.S. Cl.
USPC ..... 148/225; 148/319

(58) Field of Classification Search
USPC ..... 148/207, 223, 225, 319
See application file for complete search history.

(56) References Cited

U.S. PATENT DOCUMENTS

| | | | | |
|---|---|---|---|---|
| 4,853,046 | A * | 8/1989 | Verhoff et al. | 148/222 |
| 2008/0006346 | A1 * | 1/2008 | Sato | 148/223 |

* cited by examiner

*Primary Examiner* — Jessee Roe
(74) *Attorney, Agent, or Firm* — Craig M. Bell

(57) ABSTRACT

A process for the high temperature carburization of steel comprising heating said steel in a vacuum furnace in the presence of a hydrocarbon carburizing gas in combination with hydrogen wherein said carburizing gas/hydrogen combination is administered to the vacuum furnace by cyclically reducing the pressure in the furnace followed by the pulsed addition of the hydrocarbon carburizing gas with hydrogen at partial pressure followed by a second diffusion cycle wherein the steel is further annealed for a time sufficient to allow for the additional deposition of from about 0.8% to about 3.0% m/o of said carbon onto the surface of said steel to permit the further migration of the carbon from the steel surface to the interior thereof.

16 Claims, 5 Drawing Sheets

Comparison of Carburized Pyrowear 675 with and without A Diffusion Cycle

Effect of Diffusion Time on Surfaces Carburized for Eight Hours

Effect of Diffusion Time on Pyrowear 675 Preforms Carburized Eight Hours

STAINLESS STEEL CARBURIZATION PROCESS

CROSS-REFERENCE TO RELATED APPLICATIONS

This application is a continuation-in-part of U.S. Ser. No. 12/971,068 filed on Dec. 17, 2010, now U.S. Pat. No. 8,425,691, which claims the benefit of priority of U.S. Provisional Appln. No. 61/366,477 filed on Jul. 21, 2010.

This invention was made with United States government support under Naval Air (NAVAIR) Contract No. N68335-10-C-0173. The Government has certain rights in this invention.

FIELD OF THE INVENTION

The present invention relates generally to industrial coatings used in the protection of metal surfaces and methods for the application of said coatings onto said metal surface. More specifically, the present invention relates to the coating of iron-based and stainless steel surfaces for the protection thereof against the weather and other external environmental elements.

BACKGROUND OF THE INVENTION

Modern jet aircraft, particularly those employed in the Navy require improved hook point material in order to arrest the craft during carrier and field carrier landing practice. In arresting the craft, friction and thermal loading results from engagement and as the hook point engages and slides when mating the arresting cable. Current materials and protective surfaces are not easily manufactured and associated processing is time consuming and costly. Therefore, there have been attempts to develop new innovative alloys and processes that will be more cost and energy effective while improving performance in arresting modern aircraft. Of particular interest are the wear and corrosion resistance of surfaces that mate and slide while the arresting gear hook point engages and arrests the aircraft. It would be beneficial then to develop a material and processing that would not require external processing to protect or minimize the engaging surface against wear and corrosion. The characteristics of the alloy should also satisfy internal properties required and characteristic of stainless steel alloys.

One goal of the present invention is to develop a process for an improved performance steel using high temperature carburizing or nitriding for improved wear resistance with improved corrosion resistance in respect to stainless steel alloys without compromising internal base properties of the steel. To this end, a primary objective was to develop a carburization process that would provide a hard, wear resistant surface that would in addition provide the corrosion resistance of a martensitic stainless steel. This is accomplished by using the inherent protection of the chromium to enhance the wear resistance by formation of protective carbides, in addition to the properties afforded by martensitic formation of the base surface without sacrifice of the corrosion resistance provided by the chromium addition to the martensitic stainless steel.

Stainless steels may be classified by their crystalline structure into three main types: Austenitic, Ferritic and Martensitic. Martensitic steels are steels comprising a composition of iron, 12% chromium, and 0.12% carbon. They may be tempered and hardened. Martensitic steel possesses great hardness, but has reduced toughness and is brittle; so few steels are fully hardened. Martensitic steel is formed by the rapid cooling (quenching) of austenite, which traps carbon atoms that do not have time to diffuse out of the crystal structure. This martensitic reaction begins during cooling when the austenite reaches the martensitic steel start temperature (Ms) and the parent austenite becomes mechanically unstable. At a constant temperature below Ms, a fraction of the parent austenite transforms rapidly, and then no further transformation will occur. When the temperature is decreased, more of the austenite transforms to martensite. Finally, when the martensite finish temperature (Mf) is reached, the transformation is complete. Martensite can also form by application of stress (this property is frequently used in toughened ceramics like yttrium—stabilized zirconium and in special steels like TRIP steels (i.e. transformation induced plasticity steels)). Thus, martensite can be thermally—induced or stress—induced.

Austenite (or gamma phase iron) is a metallic, non-magnetic allotrope of iron or a solid solution of iron, with an alloying element, such as ferric carbide or carbon in iron, used in making corrosion-resistant steel. In plain-carbon steel, austenite exists above the critical eutectoid temperature of 1,000° K. (730 ° C.); other alloys of steel have different eutectoid temperatures. Its face-centered cubic (FCC) structure allows it to hold a high proportion of carbon in solution. As it cools, this structure either breaks down into a mixture of ferrite and cementite (usually in the structural forms pearlite or bainite), or undergoes a slight lattice distortion known as martensitic transformation. The rate of cooling determines the relative proportions of these materials and therefore the mechanical properties (e.g. hardness, tensile strength) of the steel. Quenching (to induce martensitic transformation), followed by tempering (to break down some martensite and retained austenite), is the most common heat treatment for high-performance steels.

The addition of certain other metals, such as manganese and nickel, can stabilize the austenitic structure, facilitating heat-treatment of low-alloy steels. In the extreme case of austenitic stainless steel, much higher alloy content makes this structure stable even at room temperature. On the other hand, such elements as silicon, molybdenum, and chromium tend to de-stabilize austenite, raising the eutectoid temperature (the temperature where two phases, ferrite and cementite, become a single phase, austenite).

Austenite can contain far more carbon than ferrite, between 0.8% at 723° C. and 2.08% at 1148° C. Thus, above the critical temperature, all of the carbon contained in ferrite and cementite (for a steel of 0.8% C) is dissolved in the austenite.

One of the differences between the two phases is that martensite has a body centered tetragonal crystal structure, whereas austenite has a face center cubic (FCC) structure. The transition between these two structures requires very little thermal activation energy because it is a martensitic transformation, which results in the subtle but rapid rearrangement of atomic positions, and has been known to occur even at cryogenic temperatures. Martensite has a lower density than austenite, so that the martensitic transformation results in a relative change of volume.

Carburization is the introduction of additional carbon to the surface of a steel part in order to effect surface hardening. In gaseous carburizing, an endothermic gas, which contains carbon monoxide and hydrogen, is used as a carrier gas to displace the air in the furnace. A hydrocarbon-containing gas such as natural gas, propane or butane is added to the endothermic gas in varying quantities. The carbon monoxide from the endothermic gas and the hydrocarbon react to form nascent carbon atoms, which in turn combine with the iron in the steel to form iron carbide. The iron carbide provides the hard surface.

The steel is exposed to the carburizing atmosphere at high temperatures, e.g. temperatures in the austenitic range for the steel in question, for a predetermined time to achieve the desired depth of carbon penetration into the steel surface. This depth is called the depth of the case. Carburized or case hardened steel has many important uses because of its desirable properties. The case provides extreme hardness at the surface while the inner portion, or core, beyond the case is relatively soft and ductile. Therefore, case hardened steel has excellent wear properties in combination with the toughness of the core.

In conventional gas carburizing furnaces, a carburizing atmosphere is force circulated by a fan system over the steel in the chamber at atmospheric pressures. Usually, a hydrocarbon gas, such as is found in natural gas, is utilized in combination with a carrier gas, such as an endothermic gas, as the carburizing atmosphere. The carburizing atmosphere is circulated in the furnace for a predetermined time and under predetermined conditions to carburize the steel. The various ramifications and modifications of this technique are well known to those skilled in the art.

Carburization of steel involves a heat treatment of the metallic surface using a gaseous, liquid, solid or plasma source of carbon. Early carburization techniques used a direct application of charcoal packed onto the metal (initially referred to as case hardening or Kolsterizing), but modern techniques apply carbon-bearing gases or plasmas (such as acetylene or methane). The process depends primarily upon gas composition, temperature, and the deposition and diffusion times, which must be carefully controlled. For applications where greater control over gas composition is desired, carburization may take place under very low pressures in a vacuum chamber.

Plasma carburization is increasingly used in major industrial regimes to improve the surface characteristics (such as wear and corrosion resistance, hardness and load bearing capacity, in addition to quality-based variables) of various metals, notably stainless steels. The process is used because it is environmentally friendly (in comparison to gaseous or solid carburization). However, the process is more expensive and requires a "line-of-sight" procedure to carburize or nitride the steel surfaces.

The process of carburization works via the implantation of carbon atoms into the surface layers of a metal. As metals are made up of atoms bound tightly into a metallic crystalline lattice, the implanted carbon atoms force their way into the crystal structure of the metal and either remain in solution (dissolved within the metal crystalline matrix (this normally occurs at lower temperatures) or react with the host metal to form ceramic carbides (normally at higher temperatures, due to the higher mobility of the host metals' atoms). Both of these mechanisms strengthen the surface of the metal, the former by causing lattice strains by virtue of the atoms being forced between those of the host metal and the latter via the formation of very hard particles that resist abrasion. However, each different hardening mechanism leads to different solutions to the initial problem. The former mechanism, known as solid solution strengthening, improves the host metals' resistance to corrosion while increasing the alloys hardness. The latter, known as precipitation strengthening, greatly improves the hardness of the alloy but normally to the detriment of the host metals' corrosion resistance. Engineers using plasma carburization must decide which of the two mechanisms matches their needs.

There are different types of elements or materials that can be used to perform this process, but these mainly consist of high carbon content material. A few typical hardening agents include carbon monoxide gas (CO), sodium cyanide (NaCN) and barium chloride (BaCl2), or hardwood charcoal. In gas carburizing, the CO is derived from a propane or natural gas source. In liquid carburizing, the CO is derived from a molten salt composed mainly of sodium cyanide and barium chloride. In pack carburization, the carbon monoxide source comes from coke or hardwood charcoal.

In pack carburizing, the work piece and carbon are enclosed in a container to ensure that contact is maintained over as much surface area as possible. Pack carburizing containers are usually made of carbon steel coated with aluminum or heat-resisting nickel/chromium alloy and sealed at all openings with fire clay. In gas nitriding the donor is a nitrogen-rich gas, usually ammonia (NH3), which is why it is sometimes known as ammonia nitriding. When ammonia comes into contact with the heated work piece it disassociates into nitrogen and hydrogen. The nitrogen then diffuses from the surface into the core of the material. This process has been around for nearly a century though only in the last few decades has there been a concentrated effort to investigate the thermodynamics and kinetics involved.

U.S. Pat. No. 4,386,973 to Herring et. al. discloses and claims a process for carburizing steel comprising carburizing said steel under vacuum in a vacuum furnace in the presence of a hydrocarbon carburizing agent while utilizing as a carrier gas an aliphatic alcohol having 1 to 4 carbon atoms. The carburizing agent is supplied during said carburizing by cyclically reducing the pressure in the furnace followed by the addition of hydrocarbon carburizing agent to the furnace to replenish gas removed in the pressure reduction step.

The carburization process per se then, is not new technology. The standard process simply introduces carbon to the surface of a steel and relies on diffusion to transport the carbon internally from the surface into the interior. There are many methods developed to accomplish this using solid state carburization, such as pack carburization, traditional gas carburization and more recently, partial pressure gas carburization in vacuum furnaces. The later process has recently been successful in the carburization of traditional low alloy and tool steels. However, owing to the problem of grain growth, the carburization temperature is usually limited to the range of 845° C. to 950° C. This requires long periods of time in order to permit sufficient diffusion to occur so as to obtain the required depth of carburization to protect against wear.

SUMMARY OF THE INVENTION

The present invention comprises the carburization of steel with a gaseous carbon compound wherein the reaction pressure is lowered. This is defined as high temperature partial pressure gas carburization, which is different than the process briefly described above. It is an improvement over the processes known in the prior art since the process of the present invention can use any carbonaceous compound in any gaseous transport medium. This can then be carried out at higher temperatures to deposit the nano-size carbon particles upon an activated surface at higher temperatures to activate the deposition and the diffusion thereof. This results in significantly shorter cycles for deposition and diffusion for a required depth of carburization. Preferably, after carburization to a required depth, the carbon and alloyed carbide formers are diffused for a period of from one (1) hour to three (3) hours. Carbide formers include chromium, molybdenum, cobalt, vanadium, etc.

DETAILED DESCRIPTION OF THE INVENTION

Figure 1:
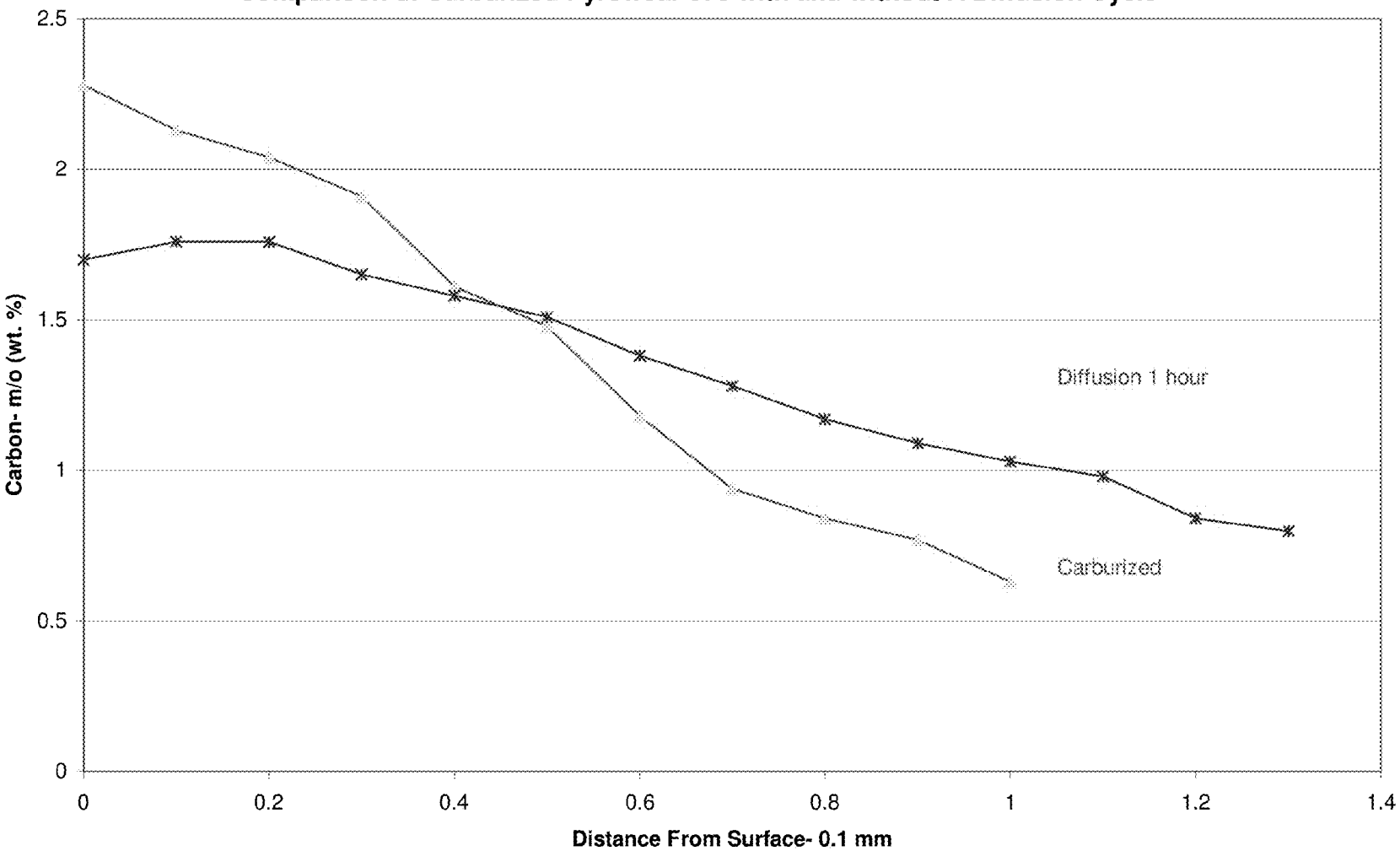
FIG. 1 is a graphic plot that shows the effect of an additional hour of diffusion after one cycle of carburization with respect to the amount of carbon migration into the steel in two (2) samples of case hardened martensitic stainless steel (Pyroware 675®).

The present invention is an improvement upon the invention disclosed and claimed in U.S. Ser. No. 12/971,068 comprising the carburization a stainless steel alloy in a gaseous carbon compound at partial pressure, which is herein defined as high temperature partial pressure gas carburization. The process of the present invention can also use any carbonaceous compound in any gaseous transport medium to deposit the nano-size carbon upon an activated surface at higher temperatures which enables the deposition and the diffusion thereof resulting in significantly shorter cycles for deposition and diffusion for a required depth of carburization. The present invention however, also comprises an additional step in the process comprising a further diffusion cycle wherein the carbon and carbide formers are further diffused for a time sufficient to allow for the further migration of the carbon from the steel surface to the interior thereof. The carbide formers consist of one or more elements comprising chromium, molybdenum, cobalt, vanadium, etc.

The present invention comprises a process for hardening stainless steel comprising carburizing said steel in a vacuum furnace in the presence of a hydrocarbon carburizing gas in combination with hydrogen. The carburizing gas/hydrogen combination is administered to the vacuum furnace by cyclically reducing the pressure in the furnace followed by the pulsed addition of the hydrocarbon carburizing gas.

More specifically, the process comprises the steps of:

(a) reducing the atmospheric pressure of the furnace by removing the air there from;
(b) introducing a partial pressure of hydrogen to reduce surface oxides as the temperature is elevated;
(c) at the selected temperature, injecting the carburizing gas/hydrogen combination into the furnace to deposit carbon on the surface for a specific time;
(d) discontinuing the carburizing gas/hydrogen feed while maintaining the temperature at a hydrogen partial pressure for a sufficient of time in order to diffuse carbon inwardly, and carburizing elements toward the surface to establish carbide equilibrium.
(e) repeating steps (c) and (d) as necessary to achieve the desired depth of hardness;
(f) allowing additional diffusion time wherein the carbon and carbide formers are further reacted for a time sufficient to allow equilibrium to result;
(g) then rapidly quenching the steel at increased pressure to produce a martensitic base;
(h) further stabilizing the martensitic structure by subjecting the as-quenched steel part to a sub-zero temperature.

Diffusion is a term of the art which refers to the process whereby the atomic components of the martensitic stainless steel such as the carbide formers, i. e. chromium, molybdenum, cobalt and vanadium, etc., migrate from the steel core outwards towards the surface of the steel while the additional carbon deposited on the surface migrates inwards to achieve equilibrium and form the most thermodynamically stable microstructure. This is achieved by holding the steel for a sufficient period of time at elevated temperatures prior to stabilization and tempering.

The hydrocarbon carburizing gas is selected from the group consisting of acetylene and methane and is preferably acetylene. The acetylene/hydrogen mixture is injected into said furnace through a pulsed injection in a ratio of from about 1:1 to about 1:10, and preferably the mixture is in a ratio of from about 1:9. The temperature within the furnace is raised to from about 480° C. to about 1300° C. while the gas is introduced therein through pulsed injection at an atmospheric pressure of about 8 torr.

Preferably, the steel is carburized at a temperature of from about 760° C. to about 1200° C. The carburization step described herein may be repeated any number of times depending upon the depth of carbon penetration desired within the steel. Preferably, the stainless steel alloy is quenched after the vacuum/heating/pulse injection/diffusion steps by discontinuing heating and increasing the pressure sufficient to rapidly quench the steel to ambient in approximately one minute. The quenched steel alloy is further stabilized at sub-zero temperatures.

In the case of a martensitic stainless steel, any carburization heat treatment requires a solution anneal at a temperature in the order of about 1000° C. to cause all carbon present in the alloy to be in solid solution, or else sensitization of the alloy occurs, resulting in the embrittlement thereof. When carburization occurs, nano-sized carbon atoms are rapidly deposited on the surface of the steel and quickly dispersed into solid solution. The carbon is then transported internally by diffusion of the atomic carbon atoms into the interior of the alloy. With respect to martensitic stainless steels, these alloys contain greater than 10% chromium. This chromium provides corrosion protection by formation of a thin, impervious oxide film that adheres to the surface, affording superior corrosion protection. However, chromium is also quite active in the formation of carbides within the grain boundaries, resulting in sensitization of the alloy that leads to grain boundary corrosion.

On the other hand, if carbon is introduced to an activated steel surface at these elevated temperatures, it also enters into solid solution rather than in the formation of carbides. Depending on the temperature used to drive the carbon to enter into solid solution, as much as 8.79 m/o carbon can be in solid solution in the iron without carbide formation. If a fast quench is then provided, the carbon transforms to unstable carbides and martensite. Once stabilized and tempered, a uniform carburized surface results without grain boundary sensitization. In fact, the carburized surface consists of a martensitic foundation homogeneously interspersed with fine carbides, providing optimum wear and corrosion resistance.

In the process of the present invention, carbon from a hydrogen/acetylene gas mixture is deposited onto a stainless steel alloy surface in a vacuum furnace at partial pressure of hydrogen. This renders all the carbon present in the alloy and deposited at the surface to be in solid solution at a high carbon potential. The stainless steel alloy is first exposed to intermittent bursts of activated dissociated carbon at the surface, followed by longer periods of time to diffuse the deposited carbon into the interior where the gradient of carbon is leaner. As a result, a carburized surface consisting of fine carbides dispersed in a tempered martensitic matrix is possible.

If the stainless steel alloy is quenched rapidly, the carbon in solution reacts with the carbide formers (present in their atomic state) and with the matrix iron to form fine carbides within a matrix of martensite. If the matrix is then stabilized in a liquid nitrogen bath followed by a tempering or aging treatment to precipitate secondary carbides, a wear resistant surface with improved corrosion resistance, and a strong, tough core is possible. The process produces a surface on the alloy that provides improved wear resistance and corrosion resistance for heavy duty machine components, in particular, arresting gear tail-hook components for naval aircraft. A well-known, commercially available steel alloy, Pyrowear 675®, useful in the practice of the process of the present invention has well established core properties.

The standard carburization process known in the art relies on a clean active surface to receive the dissociated atomic size carbon particles resulting from the dissociation of acetylene or other carbon compounds. The process then relies on the natural Brownian motion of the particles, which are dispersed in a partial pressure of hydrogen or other gas such as argon. The carbon is then transported efficiently to the activated surface of the part requiring a hard, wear resistant surface. Once the carbon is deposited on the surface, a diffusion cycle is then required to transport the highly concentrated carbon from the surface into the interior of the part.

The carburization process is dependent on two fundamental equations of state. These include Fick's second law: $D=k\cdot t$. This equation defines the carburization depth and is a function of the temperature selected for carburization and the total time for diffusion to result. The total time for diffusion includes a boost and a diffusion cycle. The second equation of importance is the ratio of the time permitted for the deposition of atomic carbon onto the surface to diffuse (td) into the alloy as a function of the time allotted for deposition of the atomic carbon on the surface (tb): $R=t_d/t_b$. The remaining factor to consider is the flow rate, which is determined as follows:

Flow Rate=C required/$t_{boost}$×0.0011 gm/cc acetylene

These fundamentals hold for any material to be carburized. However, martensitic stainless steels, such as Pyrowear 675® contain carbide formers, in particular chromium, which result in a diffusion couple that could cause possible problems in service. In the present application, the process is focused on achieving an internal equilibrium wherein the diffused carbon atoms and the outwardly migrating carbide formers (chromium, molybdenum, etc.) are fully satiated, i.e., the carbide formers are completely bound with carbon atoms.

Modification of Carburizing Thermal Cycle

A test was carried out whereby the carburization cycle was extended for one hour at 1000° C. in a partial pressure of hydrogen. The surface properties of this modified billet are described herein below. Thermal treatment of a second modification was based on the properties determined from the current carburization modification. The surface properties of the billet provided the thermal carburizing cycle with an extension of a one hour anneal in hydrogen upon termination of the carbon supply to the surface were determined. Based on this information, a further modification in the diffusion cycle was made to reduce the grain growth and transition of molybdenum and molybdenum to the Matano interface.

As opposed to the inventive process disclosed in the parent application U.S. Ser. No. 12/971,068, the present invention comprises an extended diffusion period consisting of a diffusion cycle for a time sufficient to allow for the deposition of from about 0.8% to about 3.0% m/o of said carbon onto the surface of said steel to permit the further migration of the carbon from the steel surface to the interior thereof. Several thermal cycles have been run to modify the grain growth that occurs internally at the Matano interface. The diffusion cycle was also increased once the carbon supply to the surface was satisfied. Here, the diffusion time was increased by one hour in a partial pressure of hydrogen after the applied eight boost cycles of 8 torr acetylene/hydrogen followed by 55-minute diffusion cycles in a partial pressure of hydrogen.

The additional hour in the partial pressure of hydrogen has eliminated all traces of grain growth. The carbon concentration at the surface decreased from 2.2 m/o to 1.7 m/o, and was >0.8 m/o for a distance of 1.2 mm from the surface. As a consequence, the hardness was consistent at 60 HRC for a distance of 1.3 mm from the surface and was >58 HRC for a total of 2 mm. The microstructure indicated either no or fine grained carbides at the surface, with transition to a fine-grained structure, and finally a fine-grained equiaxed structure containing a fine dispersion of carbides. SEM analysis indicated the normal diffusion of carbide formers (Cr, Mo) to the surface, with a corresponding decrease of iron and nickel. Therefore the surface appears to consist of carbides with little indication of grain boundaries.

The original carburization cycle was modified to extend the diffusion cycle by one hour to equalize the high concentration of carbon deposited on the surface. This was accomplished by first providing eight one hour cycles consisting of a five (5) minutes boost cycle of a mixture of 8 torr of acetylene/ hydrogen mixture followed by a 55 minute diffusion cycle in a partial pressure of hydrogen. This standard procedure was modified by holding the carburized billet at 1040° C. for an additional hour to permit additional diffusion of the carbon at the surface internally into the billet. After sufficient time provided for additional equilibrium, a 10 barr quench in nitrogen was provided, followed by stabilization in liquid nitrogen at −185° C. for 30 minutes. The billet was then artificially aged at 510° C. for four (4) hours. Surface properties consisting of carbon diffusion, micro-hardness and metallography were determined.

Referring now to FIG. 1, the carburization process was increased by one (1) hour of diffusion time in a partial pressure of hydrogen. The steel that was carburized in a partial pressure of hydrogen is compared with the billet that was provided the same carburization cycle, but without the additional hour for diffusion to occur. The amount of carbon deposited and infused into the steel (m/o) is shown plotted as a function of the depth the carbon migrated below the steel surface (mm). More specifically, an initial carburization (the initially applied eight boost cycles of 8 torr acetylene/hydrogen) of the stainless steel was followed by 55-minute diffusion cycles in a partial pressure of hydrogen. The additional hour in the partial pressure of hydrogen has eliminated all traces of grain growth. This also resulted in a greater equilibrium of carbon inward from the surface of the steel. The carbon concentration at the surface decreased from 2.3 m/o for the carburized only steel to about 0.65 m/o for the diffusion-treated steel at a distance of 1 mm from the surface. The carburized steel that was also diffused for an hour only decreased from about 1.7 m/o, to about >0.8 m/o at a distance of 1.3 mm from the surface. As a consequence, the hardness of the stainless steel that was further subjected to an hour of diffusion was consistent at about 60 HRC to a distance of 1.3 mm from the surface and was >58 HRC to a depth of 1.1 mm from the steel surface. The microstructure indicated the presence of carbides within a fine-grained martensitic matrix. SEM analysis indicated the normal diffusion of carbide formers (Cr, Mo) to the surface, with a corresponding decrease of iron and nickel. Furthermore, the concentration of carbon was greater than the eutectoid composition for a distance of 1.2 mm from the surface. With an additional diffusion cycle, an equilibrium value of 1 m/o carbon could result for greater carbon depth diffusion. Therefore the surface appears to consist of carbides with little indication of grain boundaries.

The original carburization cycle was modified to extend the diffusion cycle by one hour to equalize the high concentration of carbon deposited on the surface. This was accomplished by first providing eight (8) one hour cycles; each consisting of a five (5) minute boost cycle comprising an acetylene/ hydrogen mixture at 8 torr of followed by a 55 minute diffusion cycle consisting of a partial pressure hydrogen gas atmosphere. This standard procedure was modified by holding the carburized billet at 1000° C. for another hour to permit additional diffusion of the carbon at the surface internally into the billet. The additional hour of diffusion provided for more equally distributed carbon within the steel. This was followed by a nitrogen quench at 10 barr pressure and stabilization in liquid nitrogen at −185° C. for 30 minutes. The billet was then artificially aged at 510° C. for four (4) hours. The surface properties of carbon diffusion, micro-hardness and metallography were determined.

As discussed above, the degree and amount of carbon diffusion into the steel resulting from the additional one hour diffusion time is shown in FIG. 1. The steel that was carburized in a partial pressure of hydrogen is compared with the billet that was provided the same carburization cycle, but without the additional hour for diffusion to occur. Note that the initial amount of carbon concentration at the surface decreased from 2.3 m/o to 1.7 m/o. Furthermore the concentration of carbon was greater than the eutectoid composition (approximately 0.8 m/o) to a distance of 1.2 mm from the surface.

Figure 2:
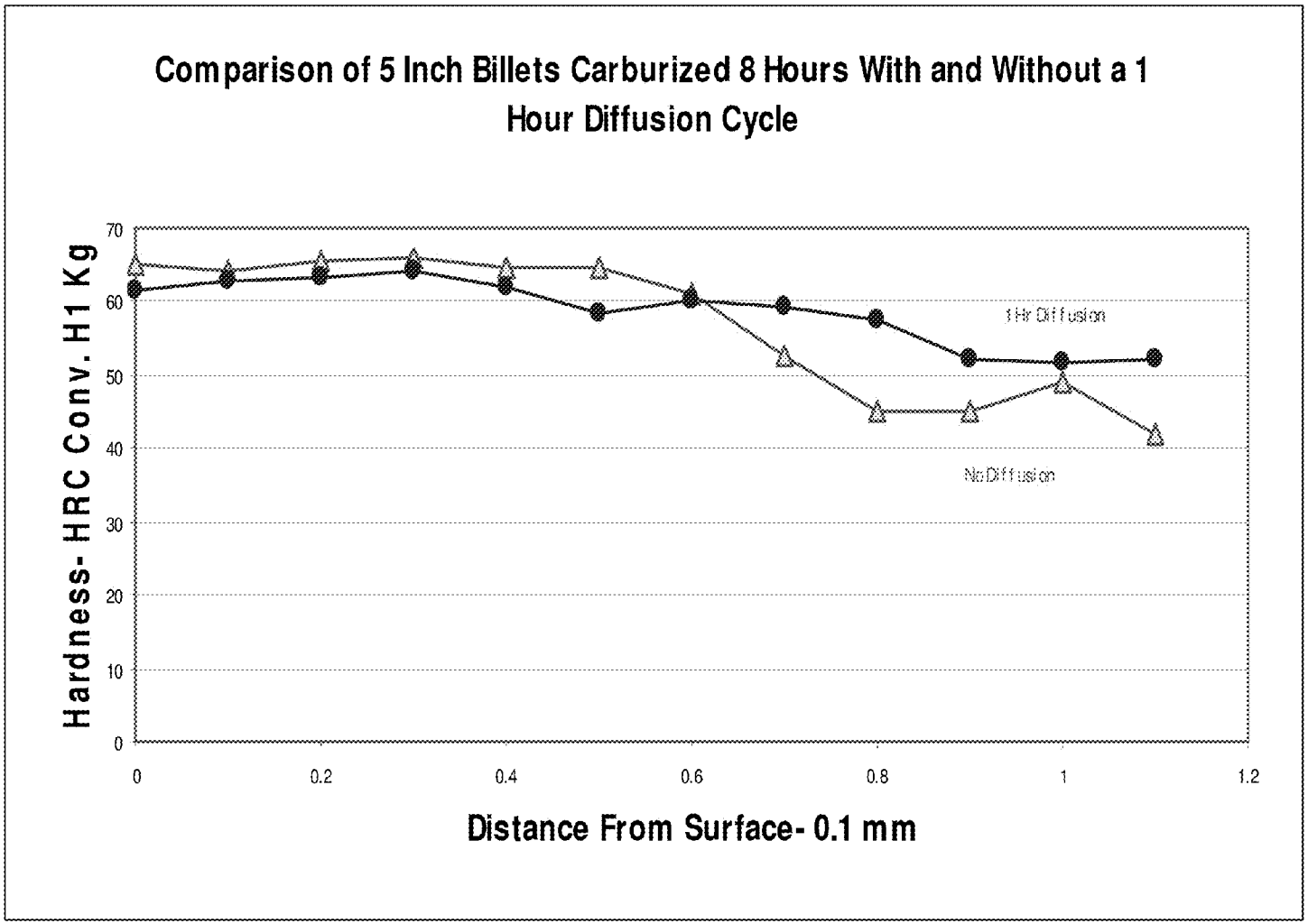
FIG. 2 is a graphic plot that shows traverses of hardness for a billet carburized for eight (8) hours alone compared with a billet carburized for eight (8) hours and then treated with an additional one (1) hour of carbon diffusion.

Referring now to FIG. 2, stainless steel billets carburized for eight (8) hours were compared with billets carburized for eight (8) hours and then treated with an additional diffusion cycle of one (1) hour of carburization in a partial pressure of hydrogen at elevated temperature. The degree of hardness (HRC) was measured and recorded as a function of distance from the surface (mm.). It was surprisingly and unexpectedly found that the considerable reduction in hardness that occurs within the carburized steel at a distance of from about 0.5 to about 1.7 mm. from the surface of the steel is eliminated. Therefore, it is evident that when the carburized stainless steel is prepared by the process disclosed and claimed in the parent application (U.S. Ser. No. 12/971,063) and then the carbon and carbide formers further reacted for one (1) hour (whereby the diffusion time is extended for this period of time after the carburization cycle), the extended diffusion treatment also increases the amount of carbon that diffuses inward vis-a-vis steel not provided with the additional carburization step.

Figure 3:
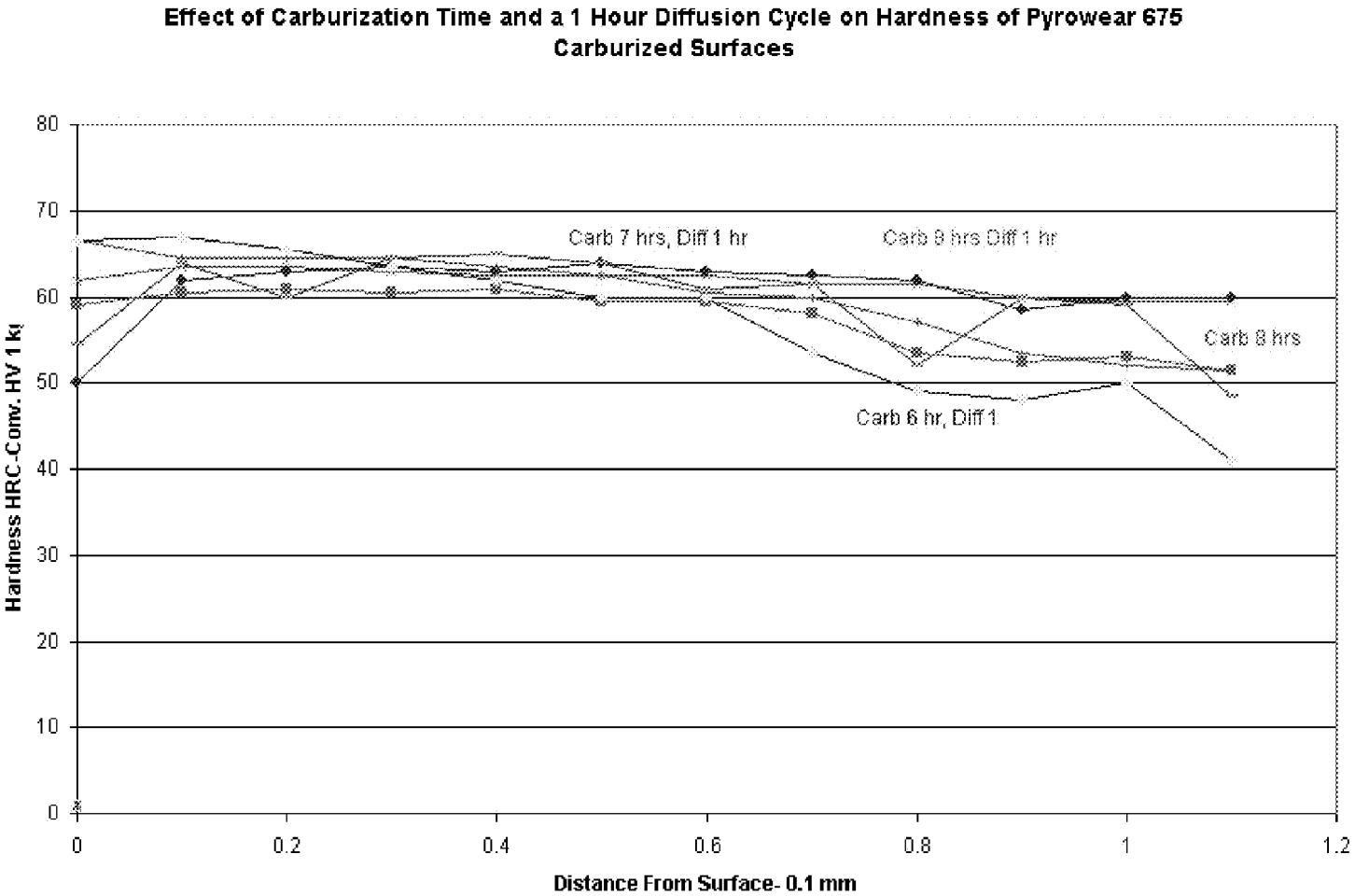
FIG. 3 is a graphic plot that shows the microhardeness (HRC) of carburized steel as a function of depth from the steel surface of martensitic stainless steel samples after carburization alone and of six, seven or eight hours of carburization followed by an additional period of diffusion of one (1) hour.

Referring now to FIG. 3, the graphic plot shows the microhardness (HRC) of carburized steel as a function of depth from the steel surface of martensitic stainless steel samples after carburization cycles of eight (8) hours alone and carburization of eight (8) hours followed by diffusion of one (1) hour. This is also compared with steel that is treated for seven (7) hours followed by diffusion of one (1) hour. It is quite evident that the added hour of diffusion time in addition to that of the initial period of carburization, results in an increased hardness profile as measured from the surface of the steel inward that is directly correlated to a lesser reduction in the carbon concentration measured within the steel as one moves from the surface inward.

Figure 4:
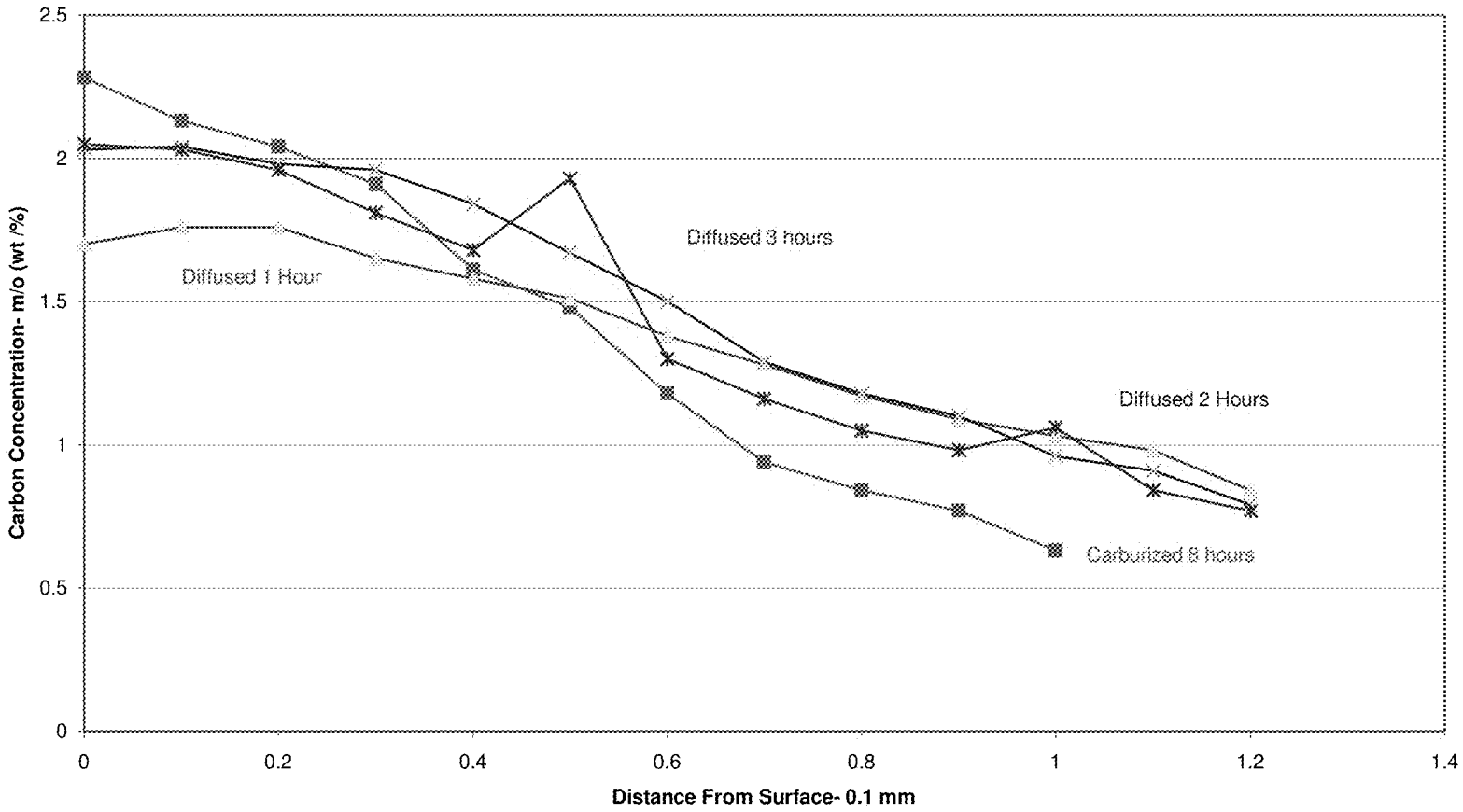
FIG. 4 is a graphic plot that shows the distribution of carbon concentration from the surface of martensitic stainless steel samples after eight (8) hours of carburization alone and carburization followed by one (1) hour, two (2) hours and three (3) hours of diffusion.

Referring now to FIG. 4, four samples of stainless steel were subjected to different carburization cycles and analyzed with respect to the amount of carbon that migrated from the surface inward. Whereas one stainless steel sample (the control) was only carburized for eight (8) hours, three other samples were carburized for the initial eight hour cycle and then treated for an additional one (1), two (2) and three (3) hours respectively. Again, carbon concentration was measured and plotted as a function of the distance from the surface. It is evident that the steel that was only treated with one (1) eight hour diffusion cycle had a lesser degree of carbon diffusion into and from the surface of the steel part than the other three parts which were also subjected to additional carbon diffusion cycles wherein the carburized billet was held at 1000° C. for an additional one, two and three hours respectively. It is evident that when the carburized stainless steel is prepared by the process disclosed and claimed in the parent application (U.S. Ser. No. 12/971,068) and then subjected to additional periods wherein the carbon and carbide formers are further diffused, the amount of carbon that is diffused below the surface increases and the stainless steel hardness and depth of increased carbon concentration increases.

Figure 5:
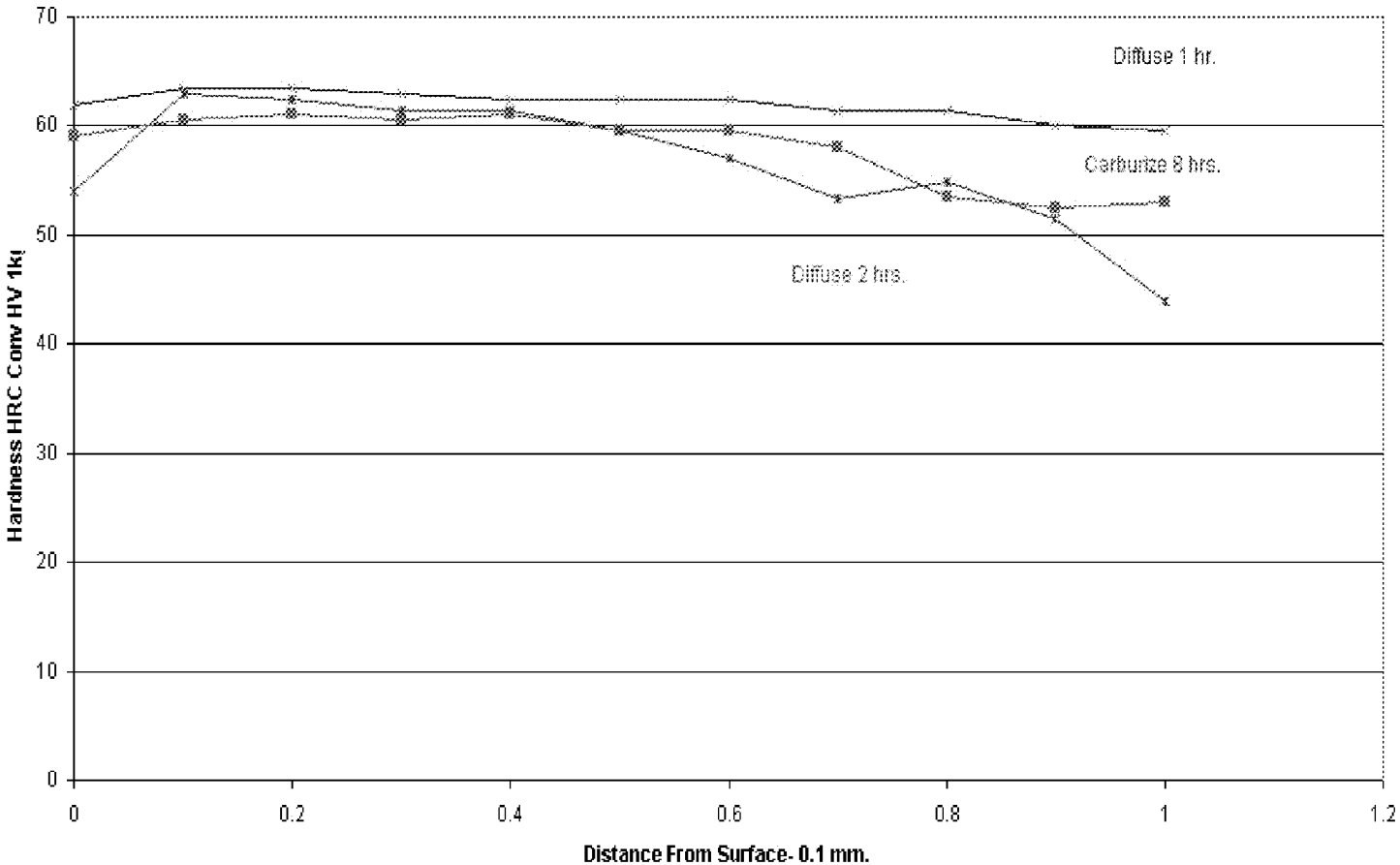
FIG. 5 is a graphic plot that shows the effect of one (1) or two (2) hours of additional diffusion time and its correlation with an increase in hardness of the steel after one cycle (eight [8] hours) of carburization as shown as a function of the distance of carbon migration from the steel surface.

Referring now to FIG. 5, three (3) samples of stainless steel were subjected to different carburization cycles and analyzed with respect to the hardness of the steel (HRC) as measured as a function of the distance measured from the surface of the steel inward. Whereas one stainless steel sample (the control) was only carburized for eight (8) hours, two other samples were carburized for the initial eight hour cycle and then treated to a diffusion cycle for an additional one (1) or two (2) hours respectively. Again, the hardness of the stainless sample (HRC) was measured and plotted as a function of the distance from the surface. It is evident that the steel that was only treated with one (1) eight hour diffusion cycle had a lesser degree of hardness resulting from the carbon diffusion into and from the surface of the steel than the other two samples which were also subjected to additional carbon diffusion cycles wherein the eight hour carburized billet was held at 1000° C. for and additional one and two hours respectively. It is evident that when the carburized stainless steel is prepared by the process disclosed and claimed in the parent application (U.S. Ser. No. 12/971,068) and then subjected to additional periods wherein the carbon and carbide formers are further diffused, the amount of carbon that is diffused below the surface increases and the stainless steel hardness and depth of increased carbon concentration increases as a result thereof.

Without being bound to any theory, it is believed that the additional diffusion occurs by the transport of atoms within a solid matrix, so that the Matano interface progresses towards its equilibrium state.

The following examples are provided to more specifically set forth and define the process of the present invention. It is recognized that changes may be made to the specific parameters and ranges disclosed herein and that there are a number of different ways known in the art to change the disclosed variables. Whereas it is understood that only the preferred embodiments of these elements are disclosed herein as set forth in the specification and drawings, the invention should not be so limited and should be construed in terms of the spirit and scope of the claims that follow.

EXAMPLE 1

For each cycle of carburization which may range from one (1) to eight (8) hours, a two (2) inch long by 2 inch (5 cm) diameter by 2 inch (5 cm) high steel cylinder was carburized. The initial carburization temperature was 1040° C. This temperature was selected because all the carbon enters in solid solution at this temperature and minimum grain growth will occur. However, it is to be understood that there may be advantages in raising the temperature to expedite diffusion. The acetylene feed into the hydrogen carrier gas was 1.5 c.c. acetylene at 8 torr total pressure. This provided a mixture of 18.75% acetylene to 81.25% hydrogen. The first series of tests were made to determine the depth of carburization required to obtain a minimum hardness of 58 HRC to a depth of 1 mm; the total carburizing time was studied for 1, 2, 3, 4, 6 and 8 hours. An initial boost of acetylene was provided for 5 minutes at a carburization temperature of 1040° C. This was followed by a diffusion cycle of 55 minutes for each hour for the total carburizing time required. After the total carburizing time occurred, the cylinder was quenched to ambient temperature at 10 barr. The cooling rate was of the order of one (1) minute to quench from 1040° C. to 540° C. At this cooling rate it was presumed that all carbon present would be transformed to fine carbides and martensite. Initially, carbon and hardness measurements were made to define the depth of carburization prior to stabilization and artificial aging. The process of the present invention consists of the following steps:

1. Evacuate furnace to 100 microns pressure.
2. Introduce 50 scfh* of hydrogen gas.
3. Increase the temperature to 1000° C.
4. Inject acetylene/hydrogen mixture at 8 torr pressure at the beginning of each hourly cycle.
5. Maintain boost cycle for 5 minutes.
6. Discontinue boost and maintain hydrogen at 50 torr pressure. One may then repeat steps 5 and 6 for the number of boost/diffuse cycles desired or inject carbon to attain the desired depth of carburization.
7. After last diffuse portion of cycle, 10 barr quench in nitrogen gas from 1000° C. to ambient.
8. Stabilize at −185° C. in liquid nitrogen.

* Cubic feet per hour of gas flow at specified standard conditions of temperature and pressure Eight complete cycles, ranging from one to eight hours' carburizing time was completed under these conditions. The measured surface properties consisted of:

a) Carbon concentration to a depth of 1 mm from the surface.
b) Hardness to a depth of 1 mm from the surface.
c) Chromium and molybdenum concentration from a depth of 1 mm from the surface.
d) The steel microstructure.

The carbon distribution resulting from the one hour diffusion time in a partial pressure of hydrogen was compared with the billet that was provided the same carburization cycle, but without the additional hour diffusion, Again, see FIG. 1. The carbon concentration at the surface decreased from 2.3 m/o to 1.7 m/o, Furthermore the concentration of carbon was greater than the eutectoid composition for a distance of 1.2 mm from the surface.

As noted previously the degree of hardness (HRC) measured as a result of increasing the diffusion cycle is shown as FIG. 2. Note that the hardness is 60 HRC or greater for a distance of 1.2 mm from the surface. In addition, the hardness is >58 HRC to a depth of 2 mm. At the surface there is either a lack of crystallinity or an extremely fine grained structure. In addition, approximately 0.5 mm inward from the surface, there is a transition from either extremely fine grain or carbides, to a fine grained equiaxed structure containing fine carbides to a depth of almost 2 mm. Thereafter there is further equiaxed grain growth with internal fine carbides, but the grains are not larger than at the core. The core consists of the normal lath type martensite that is traditionally consistent to the microstructure of the alloy. There also appears to be no concentration of carbides within the grain boundaries that would limit ductility, toughness and wear and corrosion resistance.

Again, it is evident that there is a strong migration of the carbide formers (chromium and molybdenum) toward the surface where there is an abundant supply of carbon. The data therefore indicates that there is a strong concentration of chromium and molybdenum carbides at the surface within a matrix of tempered martensite. This situation appears to be true to a depth of approximately 0.5 mm. At this point there is still strong carbide formation with chromium and molybdenum, however, diffusion internally into small grains appears to be incomplete. Beyond the depth of 1 mm, there still appears to be transport of carbon within the grain boundaries, however, although the grains continue to become larger, they do not exceed the grain size of the internal microstructure. The difference at this point appears to be that there is fine carbide formation in equiaxed grains rather than the lath martensite comprising the internal microstructure.

After quenching, chips were machined from the surface inward in 0.1 mm. intervals to determine the carbon profile after carburization. These profiles are included as FIG. 1. The stainless steel cylinder initially has a carbon concentration of about 2 m/o at the surface, which diminishes as it is diffused inwardly as a function of time. After a nine (9) hour carburization cycle, the carbon concentration is 0.8 m/o at a distance 1 mm. from the surface, satisfying the requirement for minimum hardness of 58 HRC. A similar traverse showing the hardness profile is included as FIG. 5. The profile also shows that a hardness >58 HRC extends for a distance of 0.7 mm from the surface inward. However, in all cases, regardless of carburization time, there is a precipitous fall-off in hardness followed by a recovery to some level of hardness, eventually reaching the level of the core hardness of 44 HRC. For a distance of approximately 0.2 mm there is no evidence of microstructure other than fine (what is believed to be) carbides that exists for an additional 0.2 mm. from the surface. From that distance further into the core, grain growth is prevalent with clear evidence of carbide transport through grain boundary diffusion. This is a non-stabilized carburized surface. Micrographs of the structure that resulted from the additional stabilization and aging cycle show that the carburized surface actually consists of possibly six (6) distinct layers. The micrograph shows the structure of the surface. It consists of carbides concentrated within grain boundaries with additional carbides homogeneously distributed within the grain in a martensitic matrix. The second layer from the surface consists of larger grains with carbides distributed within the grains in a higher concentration of martensite. The third layer shows the same microstructure but within coarser grains. The fourth layer shows a transition where less finer carbides appear to be dispersed in martensite with faint evidence of grain boundaries. The fifth layer shows more of the same whereas the sixth layer begins a transition to the lath martensite characteristic of the core. This is the characteristic microstructure and hardness profile expected.

Since the carburized material had not been stabilized at this point, the stainless steel was stabilized in liquid nitrogen at −185° C. for 30 minutes, followed by aging at 510° C. for four (4) hours. Again, a hardness traverse was made to determine the depth of hardness of the carburized surface after these additional heat diffusion steps were made. FIG. 4 shows the degree of hardness comparing the billet in the various stages of heat treatment. It is clear that the stabilization treatment of −185° C. succeeded in stabilizing the carburized surface, resulting in a traverse of 60 HRC or greater to a depth of 1.5 mm and a further hardness of >55 HRC to a depth of 2 mm.

EXAMPLE 2

In the present example, a carburization cycle was established to enhance diffusion of carbon and the carbide formers to establish equilibrium. For each carburization cycle, a 2-inch (5 cm) diameter by 2-inch (5 cm) high cylinder was carburized. The initial diffusion temperature was established a 1040° C. This temperature was selected because all the carbon enters into solid solution at this temperature and minimum grain growth would occur. However, it is to be understood that there may be advantages in raising the temperature to expedite diffusion. The acetylene feed into the hydrogen carrier gas was 1.5 cc acetylene, using hydrogen as the carrier gas at 8 torr total pressure. This feed provided a mixture of 18.75% acetylene to 81.25% hydrogen. In order to increase the depth of carburization required to obtain a hardness of 58 HRC to a minimum depth of 1 mm, the total carburizing time, the temperature, feed rate and time for carburization was maintained as set forth in Example 1 above. An initial boost of acetylene was provided for 5 minutes when the carburization temperature of 1040° C. was attained, followed by a diffusion cycle of 55 minutes each hour for the total carburizing time required. After carburizing for a total of eight hours, additional reaction time was included to permit the diffusing carbon at the surface and the carbide formers diffusing from the interior to approach equilibrium, thereby minimizing or eliminating the effect of the Matano interface and the loss of hardness and grain growth that ensues. A series of experiments were initiated that included diffusion cycles ranging from one to three hours, the diffusion cycle being held constant as described above. After the total carburizing time, the round billet was provided a 10 barr quench to ambient. The cooling rate was of the order of 1 minute to quench from 1040° C. to 540° C. At this cooling rate it was presumed that all carbon present would be transformed to fine carbides and martensite. Carbon and hardness traverses were made to define the depth of carburization.

A Chemical Analysis of the Surface Strata of a Carburized Ten (10) Barr Quenched, Stabilized and Aged Two Inch Billet

| Dist From Surface-mm | Chromium-m/o | Iron-m/o | Molybdenum-m/o |
|---|---|---|---|
| 0.05 | 26.19 | 54.55 | 4.03 |
| 0.20 | 28.30 | 52.64 | 4.13 |
| 0.50 | 22.47 | 60.31 | 3.42 |
| 0.75 | 16.59 | 68.93 | 2.57 |
| 1.00 | 16.74 | 70.77 | 2.3 |

-continued

A Chemical Analysis of the Surface Strata of a Carburized Ten (10) Barr Quenched, Stabilized and Aged Two Inch Billet

| Dist From Surface-mm | Chromium-m/o | Iron-m/o | Molybdenum-m/o |
|---|---|---|---|
| 1.50 | 16.39 | 71.14 | 2.75 |
| 2.00 | 17.62 | 68.78 | 2.9 |
| core | 15.70 | 82.64 | 1.8 |

Note that there is an increase of the chromium, molybdenum, and other carbide forming elements at the surface, with a corresponding decrease in the iron and nickel concentrations. Without being bound to any theory, it is believed that the migration of these elements to the surface results in a stable formation of particulate carbides, with the balance of the carbon reacting with the iron to form a martensitic matrix. However, transport of the carbide formers is believed to be through grain boundary diffusion and transport of internal carbides to the surface to combine with the available carbon supply. This in turn leaves a diluted region of internal carbides possibly consisting of large austenitic grains surrounded by grain boundaries that appear to be fully carburized. This is designed to either minimize or eliminate the transition zone that is present as a result of the carburization process.

A solution to the problem was believed to be possible if more diffusion time were permitted to occur after carburization was completed. Three carburization cycles were conducted to permit the carburized surface to remain at 1040 ° C. for 1, 2 or 3 hours at temperature in a partial pressure of hydrogen. Each carburization cycle consisted of a procedure whereby a mixture of 1.5 torr acetylene and 5.5 torr hydrogen was injected into the furnace for five (5) minutes, followed by a diffusion time of 55 minutes, for a total of eight cycles, or eight hours' duration.

After each carburization, chips were machined from the surface inward in 0.1 mm intervals up to a maximum of 1 mm depth to determine the carbon profile after carburization. These profiles are included as FIG. 5. The cycle initially has a carbon concentration of −2 m/o at the surface, which diminishes as it is diffused inwardly into the interior as a function of time. After an eight hour carburization cycle, the carbon concentration is 0.8 m/o at a distance of 1 mm from the surface, which is a minimum hardness of 58 HRC. When diffusion cycles were included, after carburizing for eight hours, the initial carbon content at the surface appeared to decrease. Hence diffusion is occurring as a result of adding the diffusion cycle and the carbon is also higher as the distance from the surface increases.

What is claimed is:

1. A process for the high temperature carburization of stainless steel comprising heating said steel in a vacuum furnace in the presence of a hydrocarbon carburizing gas in combination with hydrogen, wherein said carburizing gas/hydrogen combination is administered to the vacuum furnace by cyclically reducing the pressure in the furnace followed by the pulsed addition of the gases at partial pressure to incorporate the carbon into the steel followed by an additional diffusion cycle consisting of only the continued application of high temperature heating for a time sufficient to permit the further migration of said carbon from the steel surface to the interior thereof.

2. The process as recited in claim 1 wherein:

(a) the atmospheric pressure of the furnace is reduced by removing the air therefrom;

(b) the hydrogen gas is then introduced in an amount sufficient to create a partial atmospheric pressure of hydrogen therein of about 8 torr in order to reduce the surface oxides on the stainless steel as the temperature is elevated;

c) the carburizing gas/hydrogen combination is then injected into the furnace at a pre-selected temperature to deposit carbon on the surface of the steel for a specific time;

(d) the carburizing gas/hydrogen feed is discontinued while the temperature of the furnace is held constant and the hydrogen partial pressure is maintained for a sufficient time in order to diffuse carbon inwardly and the internal carburizing elements outwardly toward the stainless steel surface to establish a carbon/carbide equilibrium;

(e) steps (c) and (d) are then repeated as necessary to achieve a desired depth of carbon diffusion;

(f) the high temperature heating is continued for a time sufficient that allows the carbon and carbide formers in the steel to further react to establish an equilibrium;

(g) rapidly quenching the steel at increased pressure to produce a martensitic base;

(h) further stabilizing the martensitic structure by subjecting the as-quenched steel part to a sub-zero temperature.

3. The process of claim 2 wherein the percent amount of carbon that is deposited on the surface of said steel from said carburizing gas is 1.2 m/o to about 4.0 m/o.

4. The process of claim 3 wherein the percent amount of carbon that further migrates into said steel is from about 0.5 m/o to about 0.8 m/o.

5. The process as recited in claim 4 wherein said cycle is extended for a time sufficient so that excess carbon that is deposited on the surface of the steel then diffuses to an equilibrium concentration with chromium at a further depth within the steel without the occurrence of grain growth.

6. The process as recited in claim 5 wherein said steel is tempered or aged on its surface.

7. The process as recited in claim 6 wherein said hydrocarbon carburizing gas is selected from the group consisting of acetylene, methane and mixtures thereof.

8. The process as recited in claim 7 wherein said hydrocarbon/carburizing gas is acetylene.

9. The process as recited in claim 8 wherein said acetylene/hydrogen mixture is in a ratio of from about 1:1 to about 1:10.

10. The process as recited in claim 9 wherein said acetylene/hydrogen mixture is in a ratio of from about 1:9.

11. The process as recited in claim 10 wherein the temperature is raised to from about 900° F. to about 2500° F.

12. The process as recited in claim 11 wherein said hydrocarbon/carburizing gas is injected into said furnace through a pulsed injection.

13. The process as recited in claim 12 wherein said hydrocarbon/carburizing gas is introduced through pulsed injection into a furnace atmospheric pressure of from about 1 torr to about 10 torr.

14. The process as recited in claim 13 wherein said steel is carburized at a temperature of from about 760° C. (1400° F.) to about 1200° C. (2200° F.)

15. The process as recited in claim 14 wherein said quenched steel alloy is further stabilized in a nitrogen bath at sub-zero temperatures.

16. The process as recited in claim 15 wherein said quenched steel alloy is further stabilized by conducting the repeated carburization of step (e) in hydrogen to promote uniform diffusion of the nitrogen bath at sub-zero temperatures.

* * * * *